United States Patent [19]

Sakai

[11] 4,352,619

[45] Oct. 5, 1982

[54] BLAST FURNACE INSTALLATIONS

[76] Inventor: Kiyotoshi Sakai, 4-402 Tsuchitori 5-chome, Tobata-ku, Kita-Kyushu City, Fukuoka Prefecture, Japan

[21] Appl. No.: 181,356

[22] Filed: Aug. 26, 1980

[51] Int. Cl.[3] ..... F27B 1/20

[52] U.S. Cl. ..... 414/174; 266/183

[58] Field of Search ..... 414/160, 167, 169–172, 414/174, 199–206, 208; 266/176, 183, 184, 199

[56] References Cited

U.S. PATENT DOCUMENTS 3,804,392 4/1974 Kishikawa et al. ..... 266/184

3,966,062 6/1976 Sakai ..... 414/174

4,009,081 2/1977 Ueda et al. ..... 414/201 X 4,138,022 2/1979 Mochizuki et al. ..... 414/206

*Primary Examiner*—Robert G. Sheridan

*Attorney, Agent, or Firm*—Charles E. Pfund

[57] ABSTRACT

In a blast furnace installation wherein raw material is changed in a blast furnace successively through a rotary hopper, an impeller and an inclined chute surrounding the impeller, the inclined chute is suspended from a carriage movable along rails so as to decrease the weight of the chute acting upon the blast furnace.

4 Claims, 6 Drawing Figures

BLAST FURNACE INSTALLATIONS

BACKGROUND OF THE INVENTION

This invention relates to a blast furnace installation, more particularly a blast furnace installation which is constructed to efficiently mount and dismount an inclined chute device and to decrease the load upon the furnace to substantially zero.

It is a recent trend to increase the capacity of a blast furnace, and at present ordinary blast furnace has an inner volume of 4000 $m^3$, a furnace bottom diameter of about 15 m, and a yield of cast iron of 8000 tons per day. As a consequence, apparatus for charging a large quantity of raw materials into a blast furnace of such a large capacity has a large size and weight. In U.S. Pat. Nos. 3,966,062 and 4,050,679 assigned to the same assignee as this invention is disclosed a blast furnace installation comprising a blast furnace, and a raw material charging apparatus, wherein the raw material charging apparatus comprises a rotary hopper mounted above the furnace top, a conveyor for feeding raw materials to the rotary hopper, a disc shaped hollow impeller located beneath the rotary hopper, a stationary inclined chute device surrounding the impeller, and an electric motor disposed above the rotary hopper to drive the impeller at a high speed. The total weight of the blast furnace installation excepting the inclined chute is supported by supporting posts apart from the furnace and the inclined chute is supported merely by the iron plate on the furnace top so that the chute not only applies an excessive stress to the furnace but also causes deformation and warping of the furnace due to thermal expansion. Thus, this design was found unsuitable for practical use.

The inclined chute concentrically surrounds the impeller for charging the raw materials and is provided with three separate twisted passages extending downwardly from the inlet of the raw materials to three outputs located at points adequate to charge the raw material. To make easy mounting and dismounting at the time of repair and exchange the lower end of the inclined chute is constituted by a flange and a supporting ring and hermetically mounted on the top surface of the furnace. With the construction disclosed in U.S. Pat. No. 3,966,062 the total weight of the inclined chute is applied to the top of the blast furnace.

When the inclined chute becomes faulty and it is necessary to quickly repair or exchange it, the problem becomes more serious. More particularly, with the raw material charging apparatus, when it is necessary to entirely exchange it or a portion thereof particularly the inclined chute it is necessary to sequentially dismount all upper structures, i.e., the impeller, the rotary hopper, and the driving motor of the impeller so that it requires much time and labor thus reducing the yield of the furnace.

SUMMARY OF THE INVENTION

Accordingly, it is an object of this invention to provide an improved blast furnace installation permitting exchange of the inclined chute in a reasonable short time and greatly decreasing the weight of the inclined chute applied to the furnace.

Another object of this invention is to provide an improved blast furnace installation so constructed that the inclined chute will not be affected by the thermal deformation of the bast furnace.

According to this invention these and further objects can be accomplished by providing a blast furnace installation of the type comprising a blast furnace, and a raw material charging apparatus including a hollow inverted frustum shaped rotary hopper supplied with the raw material, an impeller located beneath the hopper for receiving the raw material therefrom, and inclined chute means surrounding the impeller and connected to the blast furnace for receiving the raw material discharged from the impeller to supply the same to the interior of the blast furnace, wherein there is provided means for suspending the inclined chute means thereby decreasing the weight thereof acting upon the blast furnace.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
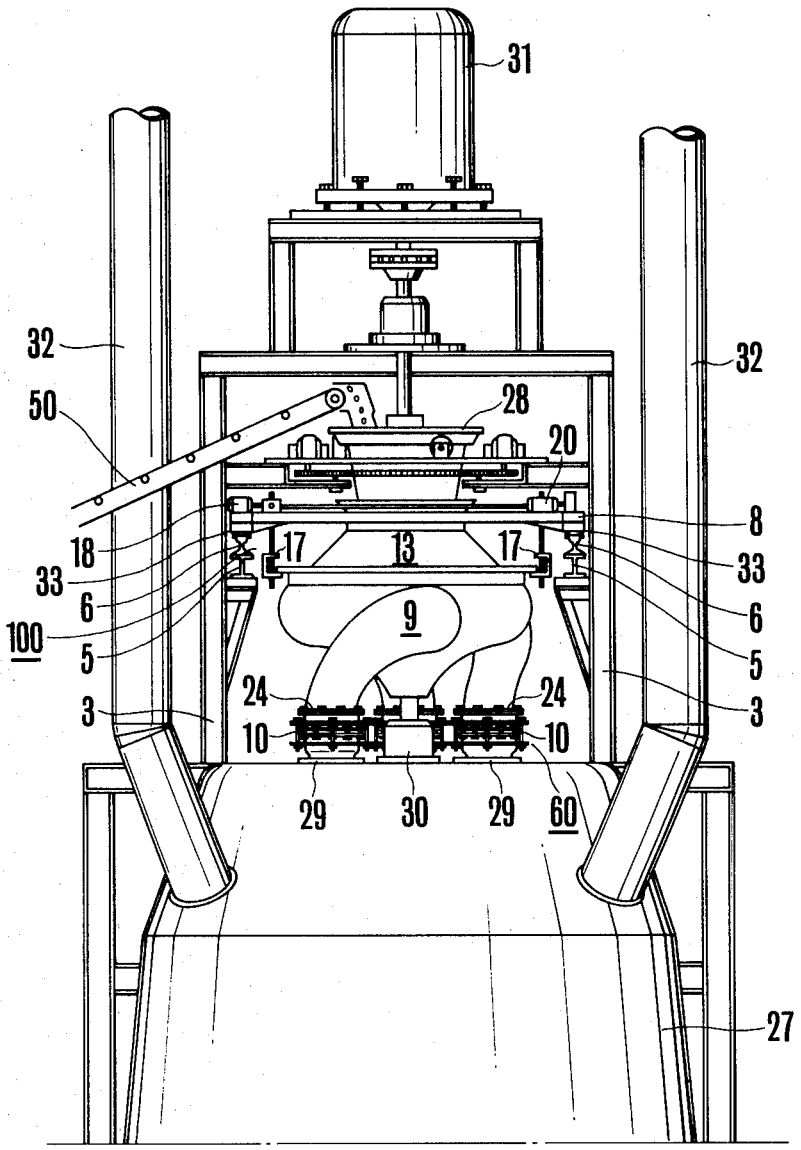
FIG. 1 is a general front view showing a blast furnace installation provided with a raw material charging apparatus embodying the invention.
Figure 2:
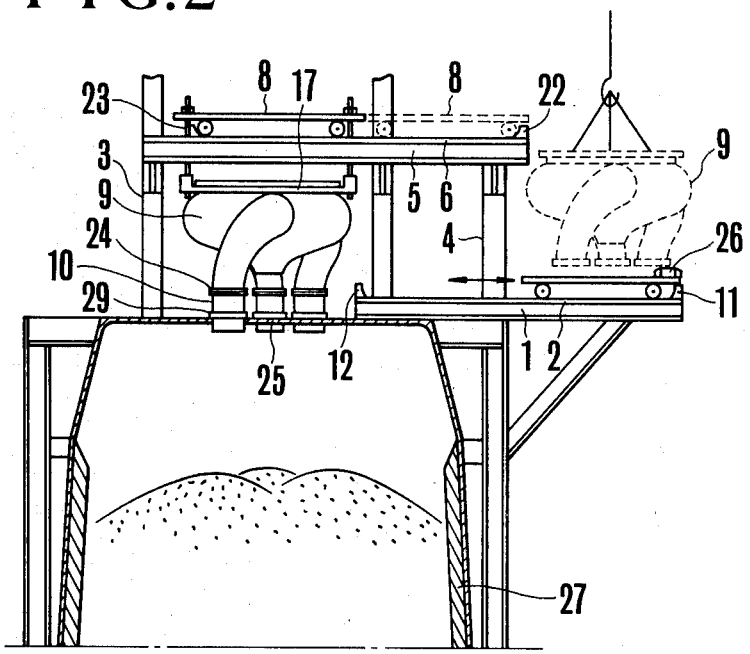
FIG. 2 is a side view showing a suspending mechanism of the inclined chute of the invention together with the blast furnace shown in section.
Figure 3:
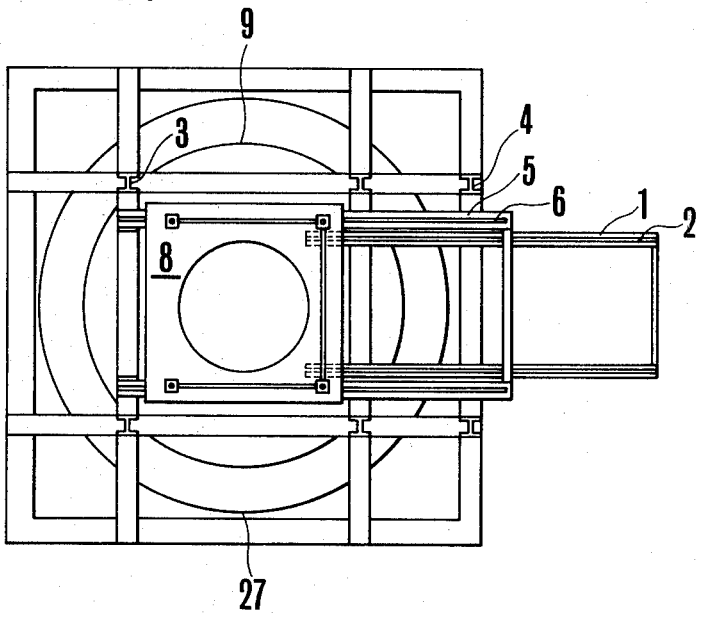
FIG. 3 is a top plan view of the suspending mechanism shown in FIG. 2.

A blast furnace installation shown in FIG. 2 has substantially the same construction as that disclosed in U.S. Pat. No. 3,966,062 except an inclined chute device 9; an inclined chute suspending mechanism including a suspending carriage 8, an elevating motor 18, a driving motor 20, hangers 17, rails 6, girders 5 and wheels 33; and inclined chute coupling devices 60. There are further provided a driving motor 31 for driving a rotary hopper 28, a conveyor 50 for supplying raw material to the rotary hopper, an impeller 13, a ball seat 30, supporting posts 3 for supporting various elements described above, and vertical exhaust pipes 32. As will be described later in detail with reference to FIG. 6, each coupling device 60 comprises a flange 24, a tube 10 and a supporting flange 29. The inclined chute supported by the supporting mechanism surrounds the impeller 13 and is connected to a top of the blast furnace 27 via the coupling devices 60.

In the preferred embodiment of the inclined chute suspending mechanism shown in FIGS. 2 through 5 comprises a pair of horizontal girders 1 for supporting rails 2. Above the girders 1, there are provided a pair of girders 5 which interconnect supporting posts 3 and support upper rails 6. The length of the upper girders 5 partly overlaps that of the lower girders 1. A carriage 7 is mounted on the lower rails 2, while a suspending carriage 8 is mounted on the upper rails 6. The upper surface of the lower carriage 7 is at a level slightly higher than the upper end of the tube 10 and the stroke of the lower carriage 7 is limited by stoppers 11 and 12 on the opposite ends of the rails 2.

Figure 4:
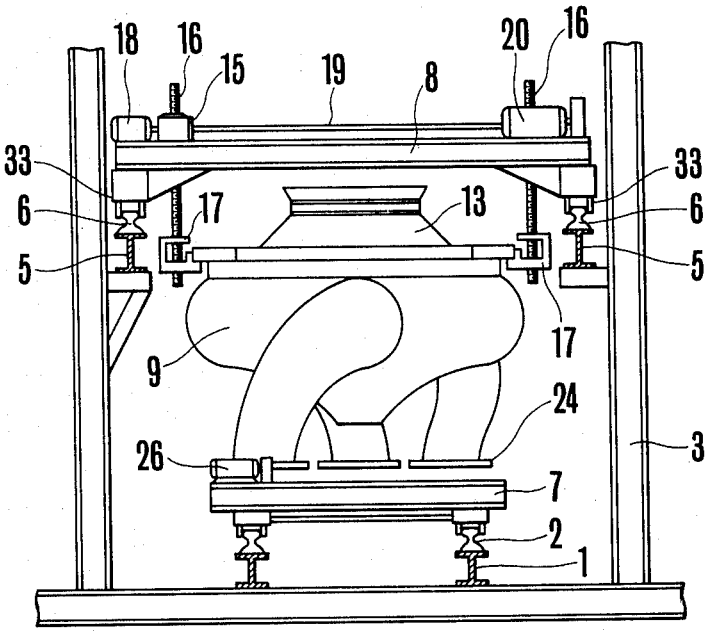
FIG. 4 is a front view showing a suspending mechanism of the inclined chute.
Figure 5:
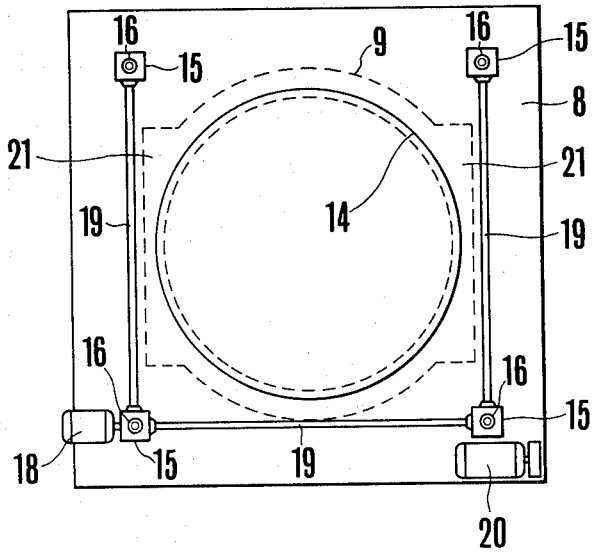
FIG. 5 is a top plan view of the suspending mechanism shown in FIG. 4

As shown in FIGS. 4 and 5, the upper suspending carriage 8 is generally square and is fabricated with strong steel frames sufficient to support the weight of the inclined chute 9 and the impeller 13. At the center of the upper carriage 8 is formed a circular opening 14 having a diameter slightly larger than the outer diameter of the impeller 13. Four gear boxes 15 are disposed about the circular opening 14 to receive threaded shafts 16. The opposite ends of a pair of hangers 17 parallel with the rails are threaded to the lower ends of the threaded shafts 16. The threaded shafts 16 are simultaneously rotated by the elevating motor 28 so as to simultaneously move in the vertical direction the hangers 17 while maintaining them in the horizontal position.

The suspending carriage 8 including the elevating mechanism and the driving motor 20 is reciprocated along rails 6 between a solid line position and a dotted line position as shown in FIG. 2 and is constructed to safely support the weight of the inclined chute.

To install the inclined chute 9 it is mounted on the carriage 7 as shown by dotted lines by a crane or the like together with an impeller contained therein. At this time, the lower portion of the inclined chute extending into the blast furnace is removed from the flange 24 and secured to the furnace head 25 together with tube 10. Then the carriage 7 is moved toward left by the motor 26 until stopped by stop means 12. Then the opposite sides of the upper flange of the inclined chute are clamped by the hangers 17 suspended from the upper carriage 8. To this end, the upper flange of the inclined chute is provided with projections 21 for engaging hangers 17 as shown by dotted lines in FIG. 5. After moving the upper carriage 8 until it is stopped by stop means 23, the lower flange 24 is connected to tube 10 through members to be described later. Then the impeller is connected to its driving motor to make zero the weight of the inclined chute applied on the furnace top or hang the inclined chute so as to minimize the weight acting upon the furnace top. Then the suspending carriage 8 is fixed by suitable means, not shown.

When it is desired to dismount the inclined chute upon occurrence of a fault or for performing periodical repair or exchange, the inclined chute and the impeller are hung by a crane after disconnecting them from the tube 10 and the carriage 8 is moved to the right until it is stopped by stop means 22 as shown by dotted lines in FIG. 2.

Then the inclined chute and the impeller are lowered onto the lower carriage 7 which is then moved toward right until stopped by stop means 11. Thereafter, the inclined chute and the impeller are lowered onto the floor by a crane.

As has been described in detail, the mounting and dismounting of the inclined chute and the impeller can be readily performed by using two carriages running along rails supported by supporting posts installed apart from the blast furnace. Moreover, this construction decreases greatly the weights of the inclined chute and the impeller acting upon the furnace.

When connecting the inclined chute to the blast furnace while it is being hung, it should be noted that the height of the blast furnace varies about 72 mm when the height of the furnace is 30 m, the average temperature of the outer shell of the furnace is 200° C., and the thermal expansion coefficient of iron is 0.000012.

Figure 6:
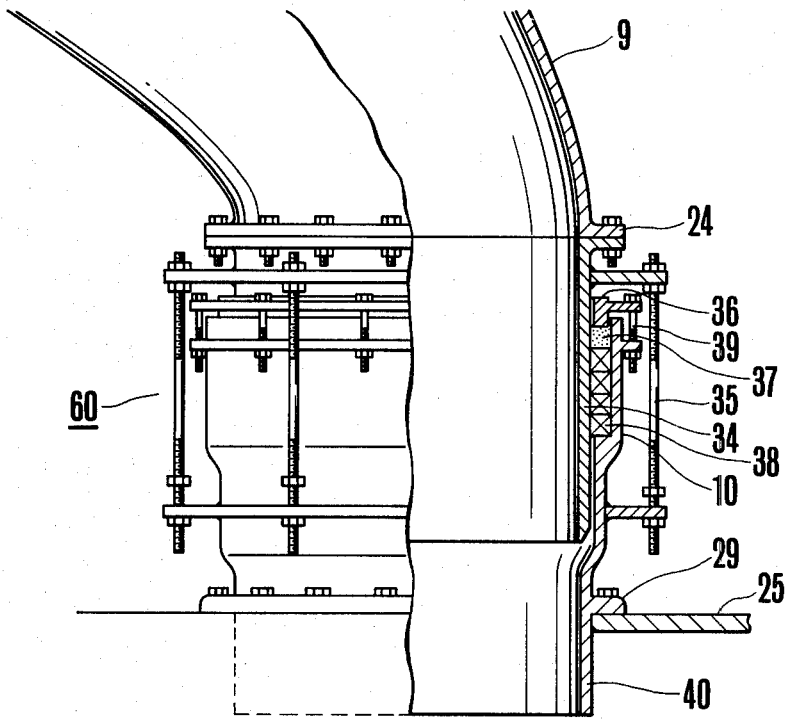
FIG. 6 is a partial sectional view showing a coupling device of the inclined chute.

FIG. 6 shows details of a connecting mechanism 60 utilized to connect the inclined chute to the furnace, which mechanism can absorb thermal expansion and constriction of the furnace. As shown, a vertical short cylindrical chute 34 is hermetically connected to the lower flange of the inclined chute 9 and the chute 34 is surrounded by the tube 10 with its lower end acting as a charging port. The tube 10 is secured to the furnace head plate 25 by an integral supporting flange 29. The upper end portion of the tube 10 is enlarged and a heat resistant packing 38 made of asbestos, for example, is packed in a gap between the enlarged portion and the cylindrical chute 34. The packing 38 is clamped by a clamping ring 36 which is adjusted by bolts 39. In this manner, the position of the cylindrical chute relative to the furnace can be adjusted through the packing 38 and the bolts 39. The connection between the chute 34 and the tube is reinforced by anchor bolts 35.

With the connecting mechanism described above, it is possible to absorb thermal expansion and constraction of the furnace.

When the horizontal alignment of the inclined chute with the discharging port of the impeller is disturbed, such misalignment can readily be corrected by the suspending carriage. Moreover, the inclined chute can be exchanged without removing upper structures.

What is claimed is:

1. In a blast furnace, installation of the type comprising a blast furnace and raw material charging apparatus including a hollow inverted frustum shaped rotary hopper supplied with raw material, an impeller located beneath said hopper for receiving the raw material therefrom, and inclined chute means surrounding the impeller and connected to the blast furnace for receiving the raw material discharged from the impeller to supply the raw material to the interior of said blast furnace, the improvement comprising means defining a support independent of the furnace, a first carriage mounted on the support for movement from a position above the furnace to a lateral position, tackle adjustably suspending the inclined chute from the carriage clear of the furnace such as to bear the weight of the inclined chute and to enable moving the inclined chute to a lateral position by lateral movement of the first carriage for dismantling the inclined chute from the furnace and a second carriage mounted on the support below the first carriage for receiving the inclined chute at said lateral position and moving it from said lateral position to a position to clear it of the overlying first carriage.

2. The blast furnace installation according to claim 1 which further comprises connecting means which connects said inclined chute means to said blast furnace, said connecting means including means for absorbing thermal expansion and constraction of said blast furnace.

3. The blast furnace installation according to claim 2 wherein said connecting means comprises a cylindrical member connected to a lower end of said inclined chute, a tube with one end secured to the blast furnace and the other end enlarged to surround said cylindrical member, a heat resistant packing member packed in a space between said cylindrical member and said enlarged end of said tube, and means for clamping said packing member thereby permitting relative axial movement between said cylindrical member and said tube.

4. In a blast furnace, installation of the type comprising a blast furnace and raw material charging apparatus including a hollow inverted frustum shaped rotary hopper supplied with raw material, an impeller located beneath said chute for receiving the raw material therefrom, and inclined chute means surrounding the impeller and connected to the blast furnace for receiving the raw material discharged from the impeller to supply the raw material to the interior of said blast furnace, the improvement comprising means defining a support independent of the furnace, first horizontal rails on the support above the furnace, a first carriage mounted on the first rails for movement from a position above the furnace to a lateral position, tackle adjustably suspending the inclined chute from the carriage clear of the furnace such as to bear the entire weight of the inclined chute, to enable vertical adjustment of the inclined chute relative to the impeller and to enable moving the inclined chute to a lateral position by lateral movement of the first carriage for dismantling the inclined chute from the furnace, second horizontal rails on the support below the first rails and a second carriage on the second rails for receiving the inclined chute at said lateral position and moving it from said lateral position to a position to clear it of the overlying first rails and first carriage.

* * * * *